US006520530B1

(12) United States Patent
Dodge et al.

(10) Patent No.: US 6,520,530 B1
(45) **Date of Patent: *Feb. 18, 2003**

(54) CORE FOR A GLIDING BOARD

(75) Inventors: David J. Dodge, Williston, VT (US); R. Paul Smith, Burlington, VT (US); Paul J. Fidrych, Waterbury, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/642,357

(22) Filed: Aug. 21, 2000

Related U.S. Application Data

(63) Continuation of application No. 08/974,865, filed on Nov. 20, 1997, now Pat. No. 6,105,991.

(51) Int. Cl.[7] ..... A63C 5/14
(52) U.S. Cl. ..... 280/610; 280/602
(58) Field of Search ..... 280/601, 602, 280/607, 608, 609, 14.21, 610

(56) References Cited

U.S. PATENT DOCUMENTS

| | | | | |
|---|---|---|---|---|
| 3,740,301 A | | 6/1973 | Manning et al. | 161/58 |
| 3,758,127 A | * | 9/1973 | Doyle et al. | 280/607 |
| 3,970,324 A | * | 7/1976 | Howat | 280/610 |
| 4,035,000 A | * | 7/1977 | Lacroix | 280/610 |
| 4,118,050 A | * | 10/1978 | Schnurrenberger | 280/604 |
| 4,175,767 A | * | 11/1979 | Scheruebl | 280/610 |
| 4,455,037 A | * | 6/1984 | Pilpel et al. | 280/610 |
| 4,498,686 A | * | 2/1985 | Pilpel et al. | 280/610 |
| 4,647,063 A | * | 3/1987 | Piringer et al. | 280/610 |
| 4,679,814 A | * | 7/1987 | Meatto et al. | 280/610 |
| 4,690,850 A | | 9/1987 | Fezio | 428/105 |
| 4,697,821 A | * | 10/1987 | Hayashi et al. | 280/609 |
| 4,706,985 A | * | 11/1987 | Meatto | 280/610 |
| 4,951,960 A | | 8/1990 | Sadler | 280/607 |
| 5,005,853 A | * | 4/1991 | Lampl | 280/610 |
| 5,135,249 A | | 8/1992 | Morris | 280/609 |
| 5,169,170 A | * | 12/1992 | Hayashi | 280/610 |
| 5,230,844 A | | 7/1993 | Macaire et al. | 264/46.7 |
| 5,238,260 A | * | 8/1993 | Scherubl | 280/610 |
| 5,366,234 A | * | 11/1994 | Rohrmoser | 280/610 |
| 5,449,425 A | | 9/1995 | Renard et al. | 156/78 |
| 5,544,908 A | | 8/1996 | Fezio | 280/610 |
| 5,573,264 A | | 11/1996 | Deville et al. | 280/602 |
| 5,580,078 A | | 12/1996 | Vance | 280/608 |
| 5,649,717 A | | 7/1997 | Augustine et al. | 280/610 |
| 6,073,956 A | * | 6/2000 | Zemke et al. | 280/610 |
| 6,105,991 A | | 8/2000 | Dodge et al. | 280/610 |
| 6,183,000 B1 | * | 2/2001 | Piatti | 280/610 |

FOREIGN PATENT DOCUMENTS

| | | | |
|---|---|---|---|
| DE | 21 35 278 | 1/1972 | |
| DE | 26 43 783 B1 | 3/1978 | A63C/5/12 |
| DE | 40 17 539 A1 | 1/1991 | A63C/5/12 |
| DE | 295 02 290.6 | 5/1995 | |
| DE | 196 04 016 | 2/1997 | |
| EP | 0 172 851 | 3/1986 | |
| EP | 0 231 734 | 8/1987 | |
| EP | 0 284 878 | 10/1988 | |
| EP | 0306 418 | 3/1989 | |
| FR | 2 655 864 | 6/1991 | |
| FR | 2 729 086 A1 | 7/1996 | |
| JP | 5-105773 | 4/1993 | C08J/5/04 |
| JP | 8-19634 | 1/1996 | A63C/5/14 |
| JP | 9-70464 | 3/1997 | A63C/5/00 |
| JP | 3053608 | 8/1998 | |
| JP | 10-216296 | 8/1998 | |
| WO | WO 97/22391 | 6/1997 | A63C/9/00 |
| WO | WO 97/27914 | 8/1997 | A63C/5/03 |

* cited by examiner

*Primary Examiner*—Brian L. Johnson
*Assistant Examiner*—Bridget Avery
(74) *Attorney, Agent, or Firm*—Wolf, Greenfield & Sacks, P.C.

(57) ABSTRACT

A core for incorporation into a gliding board, such as a snowboard. The core includes anisotropic structures that are oriented so that a principal axis is non-parallel to the orthogonal axes of the board. The core may be tuned to provide anisotropic structures with the load carrying ability specific to a localized region of the board.

92 Claims, 8 Drawing Sheets

CORE FOR A GLIDING BOARD

This application is a continuation of U.S. application Ser. No. 08/974,865, filed Nov. 20, 1997 now U.S. Pat. No. 6,105,991.

BACKGROUND OF THE INVENTION

1. Field of the Invention

The present invention relates generally to a core for a gliding board and, more particularly, to a core for a snowboard.

2. Description of the Art

Specially configured boards for gliding along a terrain are known, such as snowboards, snow skis, water skis, wake boards, surf boards and the like. For purposes of this patent, "gliding board" will refer generally to any of the foregoing boards as well as to other board-type devices which allow a rider to traverse a surface. For ease of understanding, however, and without limiting the scope of the invention, the inventive core for a gliding board to which this patent is addressed is disclosed below particularly in connection with a core for a snowboard.

A snowboard includes a tip, a tail, and opposed heel and toe edges. The orientation of the edges depends upon whether the rider his her left foot forward (regular) or right foot forward (goofy). A width of the board typically tapers inwardly from both the tip and tail towards the central region of the board, facilitating turn initiation and exit, and edge grip. The snowboard is constructed from several components including a core, top and bottom reinforcing layers that sandwich the core, a top cosmetic layer and a bottom gliding surface that typically is formed from a sintered or extruded plastic. The reinforcing layers may overlap the edge of the core and, or alternatively, a sidewall may be provided to protect and seal the core from the environment. Metal edges (not shown) may wrap around a partial, or preferably a full, perimeter of the board, providing a hard gripping edge for board control on snow and ice. Damping material to reduce chatter and vibrations also may be incorporated into the board. The board may have a symmetric or asymmetric shape and may have either a flat base or, instead, be provided with a slight camber.

A core may be constructed of a foam material, but frequently is formed from a vertical or horizontal laminate of wood strips. Wood is an anisotropic material; that is, wood exhibits different mechanical properties in different directions. For example, the tensile strength, compressive strength and stiffness of wood have a maximum value when measured along the grain direction of the wood, while the mutually orthogonal directions perpendicular to the grain have a minimum value for these properties. In contrast, an isotropic material exhibits the same mechanical property regardless of its orientation.

Wood cores have traditionally been constructed with the grain 20 of all of the wood segments running either parallel to the base plane of the core (tip-to-tail), also known as "long grain" (FIGS. 1–2), perpendicular to the base plane, also known as "end grain" (FIGS. 3–4), or in a mixture of long grains and end grains where strips of the two types of grains are successively alternated. It also has been known to orient the long grain transversely across the core, in an edge-to-edge relationship. Consequently, in known wood cores, the segments have been oriented so that the grain extends in parallel to at least one of the orthogonal axes of the core. To date, however, the mechanical properties of the wood segments have been sufficient in both axial and off-axis directions to respond to the various directional forces applied to the board.

Snowboard manufacturers continually strive to produce a lighter board. It is known to reduce the weight of a board by employing lighter density materials in the core. As the density of wood decreases, however, mechanical properties may also decrease. A lower density wood segment that is oriented in standard fashion, with a long grain running tip-to-tail or edge-to-edge or an end grain extending perpendicular to the core, may be insufficient to withstand the loads commonly applied to a board during riding. Accordingly, there is a demand for an arrangement of a lightweight core for a gliding board that is capable of carrying various on and off-axis force induced stresses.

Dynamic loading conditions encountered during riding induce various bending and twisting forces on the board. The core and reinforcing layers are the structural backbone of the board, cooperating together to withstand these shear, compressive, tensile and torsional stresses. These force induced stresses may not be applied uniformly across the board but, rather, localized regions may be subject to a greater magnitude of a particular force. However, the core may not be specifically tuned to carry these localized loads.

For example, a rider usually lands a jump on the tail end, so it is that region of the board that typically encounters significant bending loads resulting in high longitudinal shear stresses. When a rider executes a hard turn on edge, the board typically is subjected to significant transverse bending loads resulting in high transverse shear stresses in the region between the edge and centerline of the board. Because bindings are mounted in an intermediate region of the board, significant compression strength may be required to withstand high compression loads applied by the rider to this region when landing a jump or during a hard turn on edge. Further, forces exerted on the bindings may create high point loads that can lead to pull out of the binding insert fasteners. The region of the board between the rider's feet may encounter significant torsional loads due to opposing board twist along the board centerline when initiating or exiting a turn.

Accordingly, it would be advantageous to provide a core for a gliding board that is tuned to one or more specific, localized stresses or to a combination of such localized stresses.

SUMMARY OF THE INVENTION

The present invention is a flexible, durable, rider responsive core for a gliding board, such as a snowboard. The core imparts strength and stiffness so that a board incorporating the core may carry loads induced either in a direction parallel to an axis of the board as well as off-axis, or combinations thereof. The core cooperates with other components of the gliding board, such as with reinforcing layers positioned above and below the core, to provide a board with balanced torsion control and overall flexibility that quickly responds to rider induced loads, such as turn initiation and exit, that promptly recovers on landings after jumping or riding over bumpy terrain (moguls), and that maintains firm edge contact with the terrain. A gliding board incorporating the lightweight, resilient core rides fast and is easily maneuverable, and provides enhanced feel to the rider. A specific flex profile may be milled into the core, allowing a gliding board to be fine tuned to a specific range of riding performance.

The core includes a tip end, a tail end and opposed edges. Tip end refers to that portion of the core that is closest to the tip when the core is incorporated into the gliding board. Tail end, similarly, refers to that portion of the core that is closest to the tail when the core is assembled within the gliding board. The tip and tail ends may be constructed to extend the full length of the gliding board and be shaped to match the contour of the tip and tail of the gliding board. Alternatively, the core may extend only partially along the length of the gliding board and not include compatible end shapes. Symmetrical and asymmetrical core shapes are contemplated.

The core is formed from a thin, elongated member with a thickness that may vary, for example from a thicker central region to more slender ends, imparting a desired flex response to the board. However, a core of uniform thickness also is contemplated. Prior to incorporation into the gliding board, the core may be substantially flat, convex, or concave, and the shape of the core may be altered during fabrication of the gliding board. Consequently, a flat core may ultimately include a camber, and have upturned tail and tip ends, after the gliding board is completely assembled.

The gliding board preferably includes an anisotropic structure, such as wood, having a principal axis (the direction of the grain when the anisotropic structure is wood) along which a mechanical property that influences the riding performance of the gliding board has a maximum value. The principal axis may be defined by an angle relative to a plane formed by any two of the longitudinal axis, transverse axis and normal axis of the core. The anisotropic structure is oriented so that the principal axis is not in alignment with, or is not parallel to, any of these core axes. Although the anisotropic structure may be arranged to provide a maximum value for a particular contemplated load, preferably the principal axis is oriented to provide a balanced value for two or more anticipated load conditions. In the latter case, the principal axis may be oriented so that it does not provide a maximum value for any of the contemplated loads but, rather, a desired blended value. Where the anisotropic structure is wood, the grain direction of the wood does not extend in a direction that is parallel with any of the three axes. In such an off-axis orientation, the wood in the core is not oriented in long grain or end grain fashion. This off-axis orientation is particularly suited for lower density anisotropic structures. The core may be formed partially or completely of off-axis anisotropic structures. Although a wood anisotropic structure is preferred, other anisotropic structures are contemplated including a fiberglass/resin matrix, a molded thermoplastic structure, honeycomb, and the like. Furthermore, one or more isotropic materials may be formed into an anisotropic structure that is suitable for use in the present core, for example glass, which itself is isotropic, may be formed into fibers that may be aligned with each other in a resin matrix to form an anisotropic structure.

In one embodiment of the invention, the core includes a thin, elongated member having a tip end, a tail end and a pair of opposed edges. The core includes a longitudinal axis extending in a tip-to-tail direction, a transverse axis extending in an edge-to-edge direction and a normal axis. The thin, elongated member includes an anisotropic structure that has a principal axis along which a mechanical property has a maximum value, where the mechanical property is selected from one or more of compressive strength, compressive stiffness, compressive fatigue strength, compressive creep strength, tensile strength, tensile stiffness, tensile fatigue strength and tensile creep strength. The anisotropic structure is arranged in the core member so that the principal axis is not aligned with, or is not in parallel to, each of the longitudinal, transverse and normal axes of the core member. In one arrangement, the principal axis has an angle of approximately 45° relative to one of the axes of the core member. Two or more off-axis anisotropic structures may be employed in the core and, preferably, they are arranged side-by-side with the respective principal axes extending in opposite relative directions. Alternatively, a single off-axis anisotropic structure may be employed alone or in conjunction with one or more anisotropic structures that are oriented so that their respective principal axes are aligned with or parallel to the axes of the core. The one or more non-parallel or unaligned anisotropic structures may be provided throughout the core or only in selected portions of the core. The direction of the anisotropic structures in the varying portions of the core may have different orientations as compared to one another.

In another embodiment of the invention, a thin, elongated core member includes a vertical lamination of thin strips of one or more anisotropic structures, preferably extending in a tip-to-tail direction. The principal axis of at least one of the anisotropic structures extends off axis relative to the axes of the core. Two or more different strips of anisotropic structures may be arranged in an alternating pattern and, preferably, the principal axis of the two anisotropic structures extend in opposite relative directions. In a preferred embodiment, the anisotropic structure is wood and the principal axis lies along the grain of the wood. In this arrangement, the principal axis of a first anisotropic structure may be oriented at approximately 45° from the base plane toward the tip end (+45°) and the principal axis of an adjacent second anisotropic structure may be arranged at 45° from the base plane toward the tail end (−45°). Other angles of the principal axis are contemplated, and the different anisotropic structures may be formed from the same or from a different density wood.

In another embodiment of the invention, a thin, elongated core member includes at least three different anisotropic structures, each having a principal axis oriented in a direction relative to the axes of the core that differs from the others. One or more of the three different anisotropic structures may have a principal axis that is off-axis relative to the orthogonal axes of the core.

In another embodiment of the invention, a thin, elongated core member includes selected regions that may be longitudinally spaced from each other. Each spaced region includes an anisotropic structure that has a principal axis oriented in a direction that differs from the other regions, providing the core with different mechanical properties at the spaced regions.

A still further embodiment of the invention includes a gliding board incorporating a thin, elongated core as described in any of the embodiments herein. The gliding board may further include a reinforcing layer, such as one or more sheets of a fiber reinforced matrix, above and below the core. A bottom gliding surface and a top riding surface also may be provided, as may perimeter edges for securely engaging the terrain. Damping and vibrational resistant materials also may be included, as appropriate.

It is an object of the present invention to provide a lightweight core for a gliding board.

It is another object of the present invention to provide a core for a gliding board with the structural integrity to handle the anticipated mechanical loads placed on the gliding board, particularly those forces that are applied off-axis to the board.

It is a further object of the invention to provide a core for a gliding board having selected regions of varying mechanical properties that are specifically tuned to the particular loads that will be applied to that region of the core.

Other objects and features of the present invention will become apparent from the following detailed description when taken in connection with the accompanying drawings. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1:
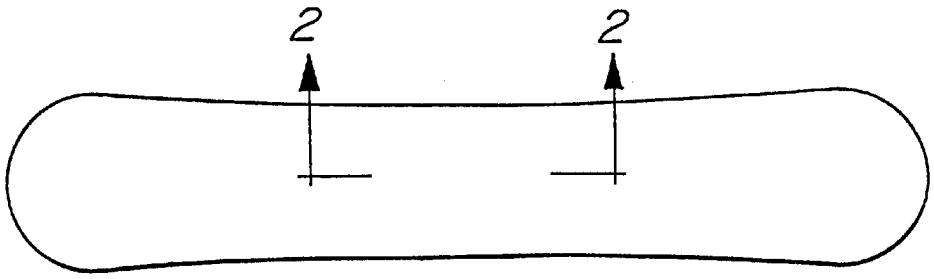
FIG. 1 is a schematic view of a wood core with long grain segments.
Figure 3:
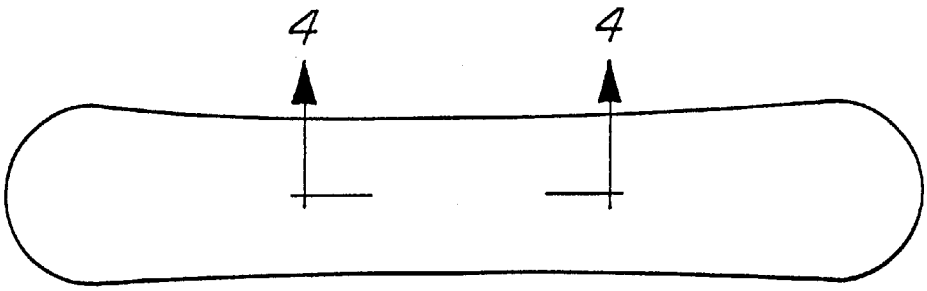
FIG. 3 is a schematic view of a wood core with end grain segments.
Figure 2:
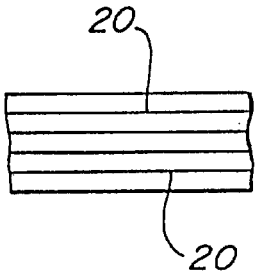
FIG. 2 is a cross-sectional view taken along section line 2—2 in FIG. 1.
Figure 4:
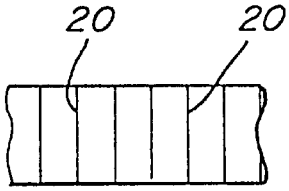
FIG. 4 is a cross-sectional view taken along section line 4—4 in FIG. 3.
Figure 5:
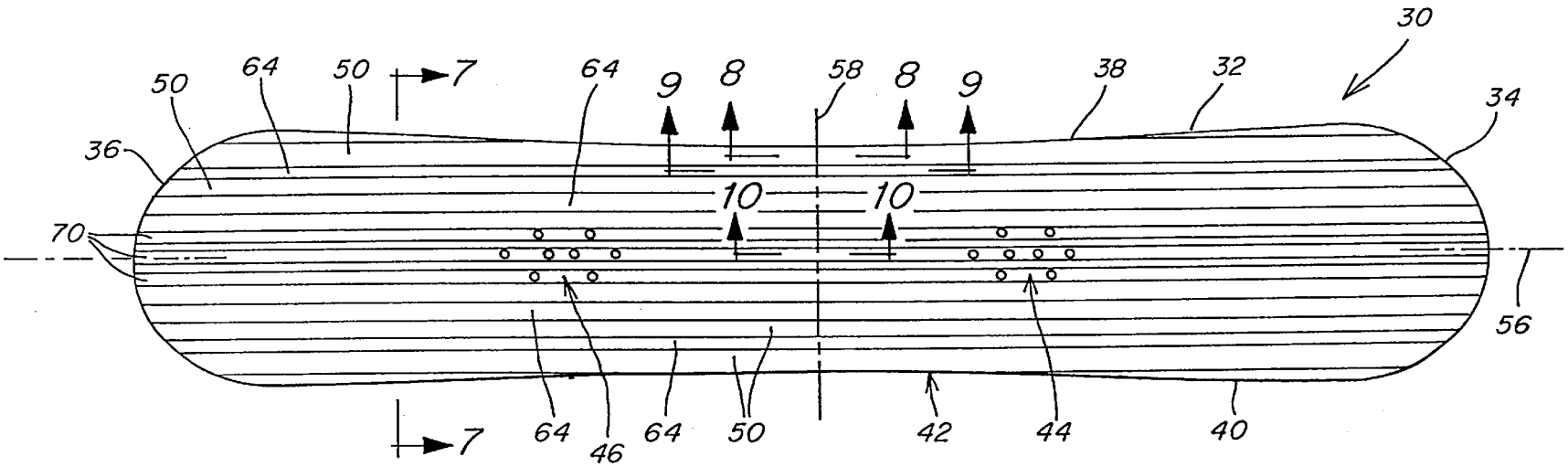
FIG. 5 is a is a top plan view of the core according to one illustrative embodiment of the invention.
Figure 6:
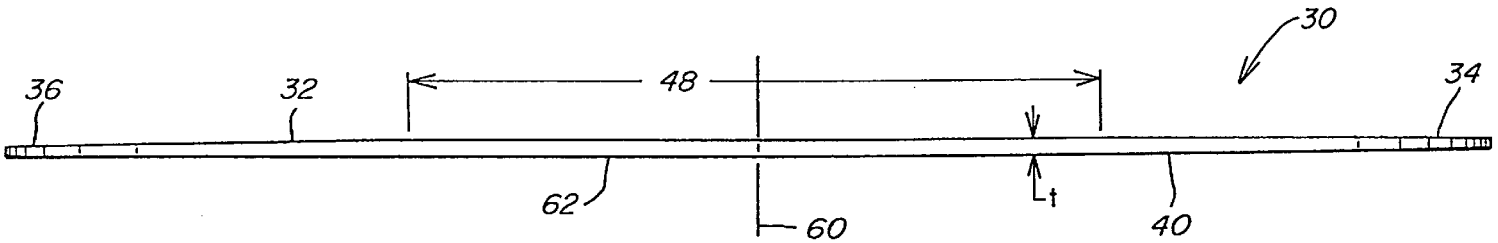
FIG. 6 is a side elevational view of the core of FIG. 5.
Figure 8:
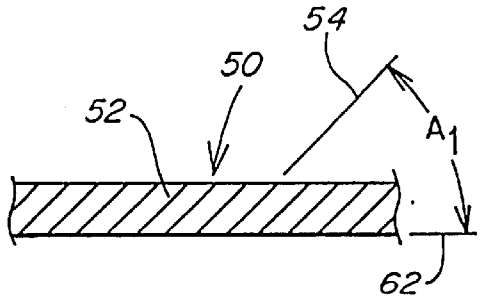
FIG. 8 is a cross-sectional view of the core taken along section line 8—8 in FIG. 5
Figure 7:
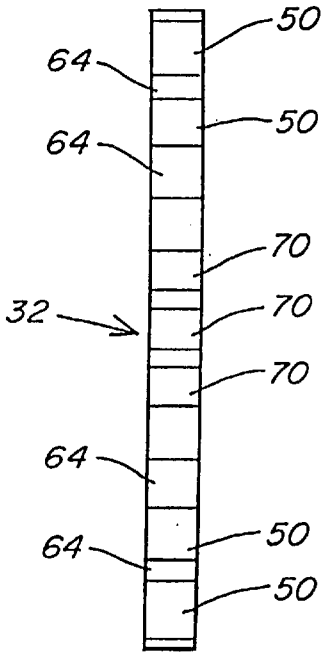
FIG. 7 is a cross-sectional view of the core taken along section line 7—7 in FIG. 5.
Figure 9:
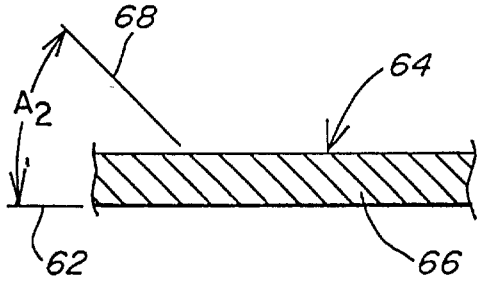
FIG. 9 is a cross-sectional view of the core taken along section line 9—9 in FIG. 5
Figure 10:
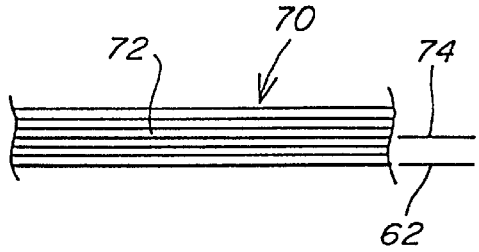
FIG. 10 is a cross-sectional view of the core taken along section line 10—10 in FIG. 5

In one embodiment of the invention, shown in FIGS. 5–10, a core is provided for incorporation into a gliding board, such as a snowboard. The core 30 includes a thin, elongated core member 32 that has a rounded tip end 34, a rounded tail end 36 and a pair of opposed side edges 38, 40 that extend between the tip end and the tail end. It is to be appreciated, however, that the core shape can be varied to conform to the desired final configuration of the board. In that respect, the core 30 may have a symmetrical or an asymmetrical shape, depending upon the desired rider flex profile of the board. Although a full length core, running tip-to-tail, is illustrated, a partial length core also is contemplated that may lack one or both of the rounded tip and tail ends. The core 30 may be provided with a sidecut 42, as shown, or may instead be constructed of a uniform width. As shown in FIG. 5, the core 30 may be provided with first and second groups 44, 46 of openings or holes that correspond to the regions where front and rear bindings, such as snowboard bindings, will be secured to the board. The openings in the core are adapted to receive fastener inserts (not shown) for securing the bindings. The pattern of the openings may be varied to accommodate different insert fastening patterns.

The core 30 may have a uniform thickness t or, preferably, may have a thickness t that varies from a thicker central region 48 that includes the openings 44, 46 for receiving the fastener inserts to the narrower, and more flexible, tip and tail ends 34, 36. In one embodiment, the thickness varies from approximately 8 mm at the central region 48 to approximately 1.8 mm at the ends 34, 36. Although the core, prior to incorporation into the gliding board, preferably is substantially flat, it also may be configured with a convex or concave shape. Further, the shape of the core may be altered during fabrication of the gliding board. Consequently, a flat core may ultimately include a camber, and the tip and tail ends may curve upwardly, after final assembly of the board.

A plurality of core segments 50 are secured together, such as by vertical lamination, to form the unitary core member 32. As shown, the core segments 50 may extend tip-to-tail and be distributed transversely across the width of the core. Alternatively, the core segments 50 may run edge-to-edge or may be distributed in more random fashion. A single core segment 50 may extend along the full length of the core or, alternatively, several shorter segments may be joined end-to-end. The width of the core segments 50 may be uniform throughout the core member 32 or may vary as desired. In one embodiment, the width of the core segments 50 may range from approximately 4 mm to approximately 20 mm, with a preferred width of approximately 10 mm.

Each core segment 50 includes at least a first anisotropic structure 52 (FIG. 8) having a principal axis 54, along which a mechanical property of the anisotropic structure has a maximum value. Such a mechanical property includes one or more of compressive strength, compressive stiffness, compressive fatigue strength, compressive creep strength, tensile strength, tensile stiffness, tensile fatigue strength and tensile creep strength. The anisotropic structure 52 is oriented so that the principal axis 54 extends in a predetermined direction and at a predetermined angle appropriate for one or more of the anticipated loading conditions to be encountered when riding the board. The angle and direction of the principal axis 54 may be defined in relation to an orthogonal coordinate system for the core that includes a longitudinal axis 56, a transverse axis 58 and a normal axis 60. The longitudinal axis 56 extends in a tip-to-tail direction along the centerline of the core, the transverse axis 58 extends in an edge-to-edge direction at the longitudinal center between the tip and tail ends 34, 36 of the core (perpendicular to the longitudinal axis), while the normal axis 60 is perpendicular to the base plane 62 of the core extending through the longitudinal and transverse axes. The coordinate system also defines a longitudinal plane extending through the longitudinal and normal axes, and a transverse plane extending through the transverse and normal axes.

The first anisotropic structure 52 is arranged in the core so that the principal axis 54 is unaligned with, or non-parallel to, any of the longitudinal, transverse or normal axes of the board. Preferably, the principal axis 54 has an angle $A_1$ of between 10° and 80° relative to one or more of the core axes or orthogonal planes defined by the axes. In the core illustrated, the principal axis 54 of the first anisotropic structure 52 has an angle $A_1$ of 45° relative to the base plane 62. Although the principal axis is illustrated as extending in the tip-to-tail direction, the anisotropic structure also could be arranged so that the principal axis extends in the edge-to-edge direction, or in a direction that is partially longitudinal (i.e. tip-to-tail) and partially transverse (i.e. edge-to-edge). Furthermore, other angles of the principal axis of the core segment of the anisotropic structure are contemplated, so long as the resulting principal axis is not parallel to any of the longitudinal, transverse or normal axes of the core.

The core 30 may include one or more second core segments 64 of a second anisotropic structure 66 (FIG. 9) having a principal axis 68 oriented at an angle $A_2$ from the base plane 62. The second core segments 64 may be located in a separate region of the core, or may be arranged in alternating fashion with the first core segments 50 of the first anisotropic structure 52 as is illustrated. The first and second anisotropic structures 52, 66 are distinguishable either by their composition or, where formed from the same type of material, then by the orientation of their principal axes 54, 68. Where the first and second anisotropic structures 52, 66 are arranged side-by-side, it may be beneficial to have the principal axis 54, 68 of the two structures extend in opposite directions. Direction may be noted by a "+" and a "−", with a "+" meaning that the principal axis slopes upwardly from the base plane towards the tip end 34 when referring to the longitudinal axis 56 or towards a toe-side edge (once defined) when referring to the transverse axis 58. Similarly, "−" may refer to a principal axis that slopes upwardly from the base plane towards the tail end 36 when referring to the longitudinal axis 56 or towards a heel-side edge (again, once defined) when referring to the transverse axis 58. Given this nomenclature, as shown, the principal axis 54 of the first core segments 50 is approximately +45° from the base plane 62 while the principal axis 68 of the second core segments 64 is −45° from the base plane 62. It is to be understood, however, that the disclosed principal axes directions are exemplary and that other orientations, ranging from 10° to 80° for the first anisotropic structure 52 and from 0° to 90° for the second anisotropic structure 66 are contemplated.

Forces exerted on the bindings may create high point loads that can cause pull out of the fastener inserts. Consequently, the core 30 may be provided with one or more third core segments 70 that includes a third anisotropic structure 72 (FIG. 10) that is capable of distributing the point loads over a larger region of the core. The third anisotropic structure 72 may be formed of a different material than the first and second anisotropic structures 52, 66 or, if formed of the same material, have a principal axis 74 with an orientation that is different from the first and second anisotropic structures 52, 66. Preferably, the principle axis 74 of the third anisotropic structure 72 extends along the length of the third segment in a plane parallel to the base plane 62 of the core to create a beam segment that effectively carries the point loads away from the fastener inserts.

As illustrated in FIG. 5, the third core segments 70 may correspond to the locations of the openings 44, 46 so that the fastener inserts will be mounted on these beam segments. To further enhance the insert retention capacity of the core, the beam segments 70 may include a higher strength material relative to the first and second core segments 50, 64. For, example, the beam segments 70 may include a higher density wood than used in the first and second core segments. Further, segments 70 of the third anisotropic structure 72 may be arranged in an alternating relationship with core segments 50, 64 of either the first or second anisotropic. structures 52, 66 or with a mixture thereof. Although the third anisotropic structure 72 is illustrated as extending from tip-to-tail, the core segments 70 may be provided only in the regions of the binding insert openings 44, 46 or in varying lengths therefrom toward the tip and tail ends 34, 36.

As discussed above, the anisotropic structures for each core segment may be oriented in predetermined directions that are suitable for handling the anticipated loading conditions to be encountered when riding the board. As may be appreciated from the discussion of the previous embodiments, various anisotropic structure orientations may be employed in different regions of the core to selectively tune localized areas of the core to particular loading conditions. To further illustrate this concept, the following examples are presented to describe several basic loading conditions that may be applied to a board and a principal axis orientation of the anisotropic structures within the core that may be suitable to handle the particular load. It is to be understood, however, that the examples are included for illustrative purposes only and are not intended to limit the scope of the invention.

Figure 11:
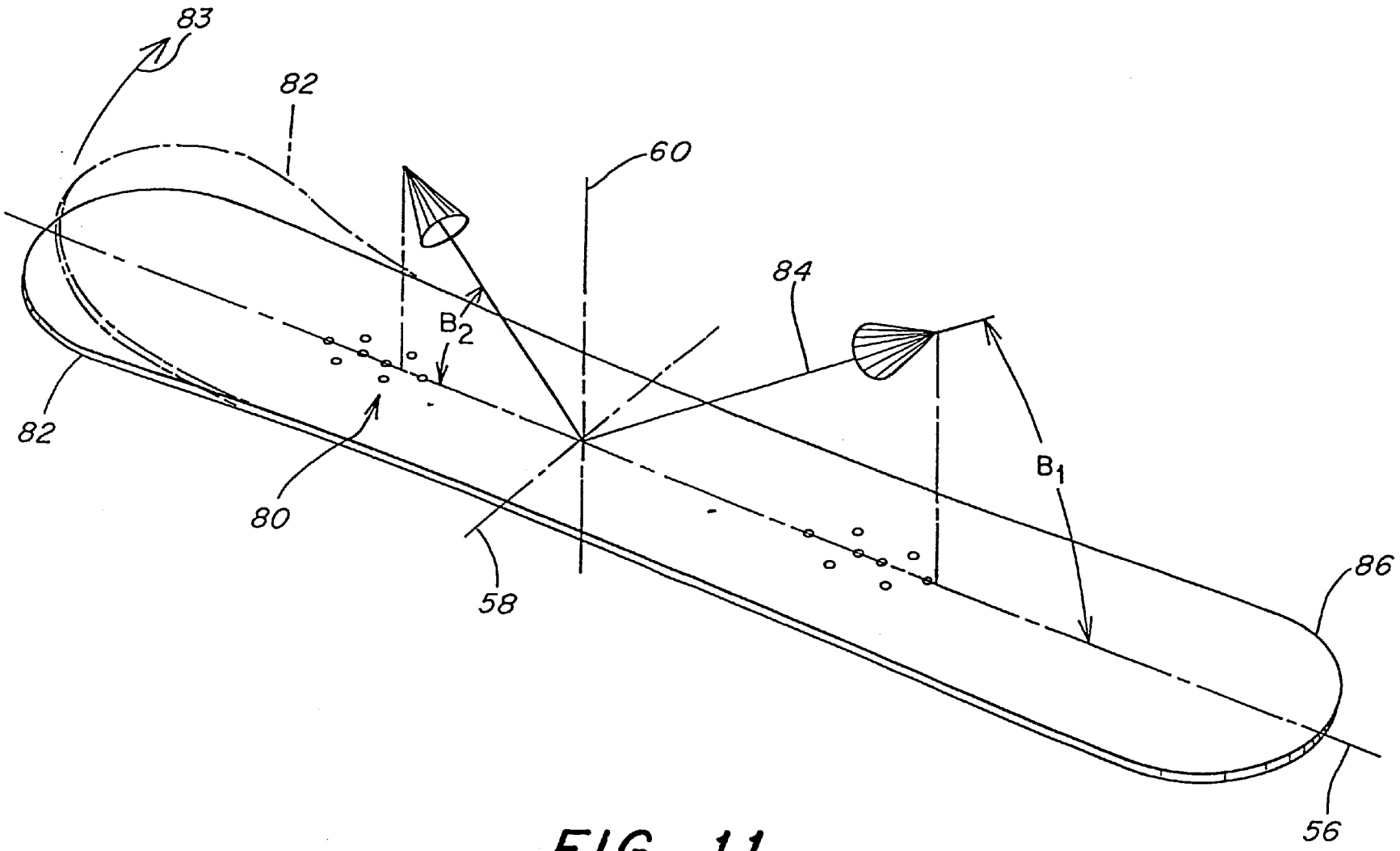
FIG. 11 is a schematic view of a core illustrating one embodiment of an anisotropic structure orientation suitable for handling a shear load due to longitudinal bending of the core.

FIG. 11 illustrates a principle axis orientation that may be particularly suitable for handling a longitudinal shear load that is applied to the core along the longitudinal axis 56 of the core approximately midway between the rear binding region 80 and the tail end 82 of the board. This loading condition may occur when landing a jump that causes the tail end 82 of the board to bend upwardly 83, as shown in phantom, along an axis that is parallel to the transverse axis 58. Under this loading condition, it may be preferable to orient the principal axis 84 in a plane that is perpendicular to the base plane and parallel to the longitudinal axis 56 and at a positive angle $B_1$ from the base plane toward the tip 86. If interested only in handling a unilateral load, such as bending in one direction, it may be desirable to orient each anisotropic structure across the width of the core in the same direction relative to the longitudinal axis. For example, the anisotropic structures across the width of the core may be oriented at an angle $B_1$ of +45° from the base plane toward the tip end 86 of the core. If interested in handling loads in both directions, such as bending the tail end 82 of the board up and down, it may be preferred to use equal proportions of anisotropic structures that are oriented in opposite directions. For example, it may be desirable to have equal proportions of anisotropic structures that are oriented at an angle $B_1$ of +45° toward the tip end and at angle $B_2$ of −45° toward the tail end. If interested in handling loads that are greater in one direction than the opposite direction, it may be preferred to use a larger proportion of one anisotropic structure as opposed to another structure. For example, it may be desirable to have a larger proportion of the anisotropic structures oriented at an angle $B_1$ of +45° toward the tip end than at an angle $B_2$ of −45° toward the tail end.

Figure 12:
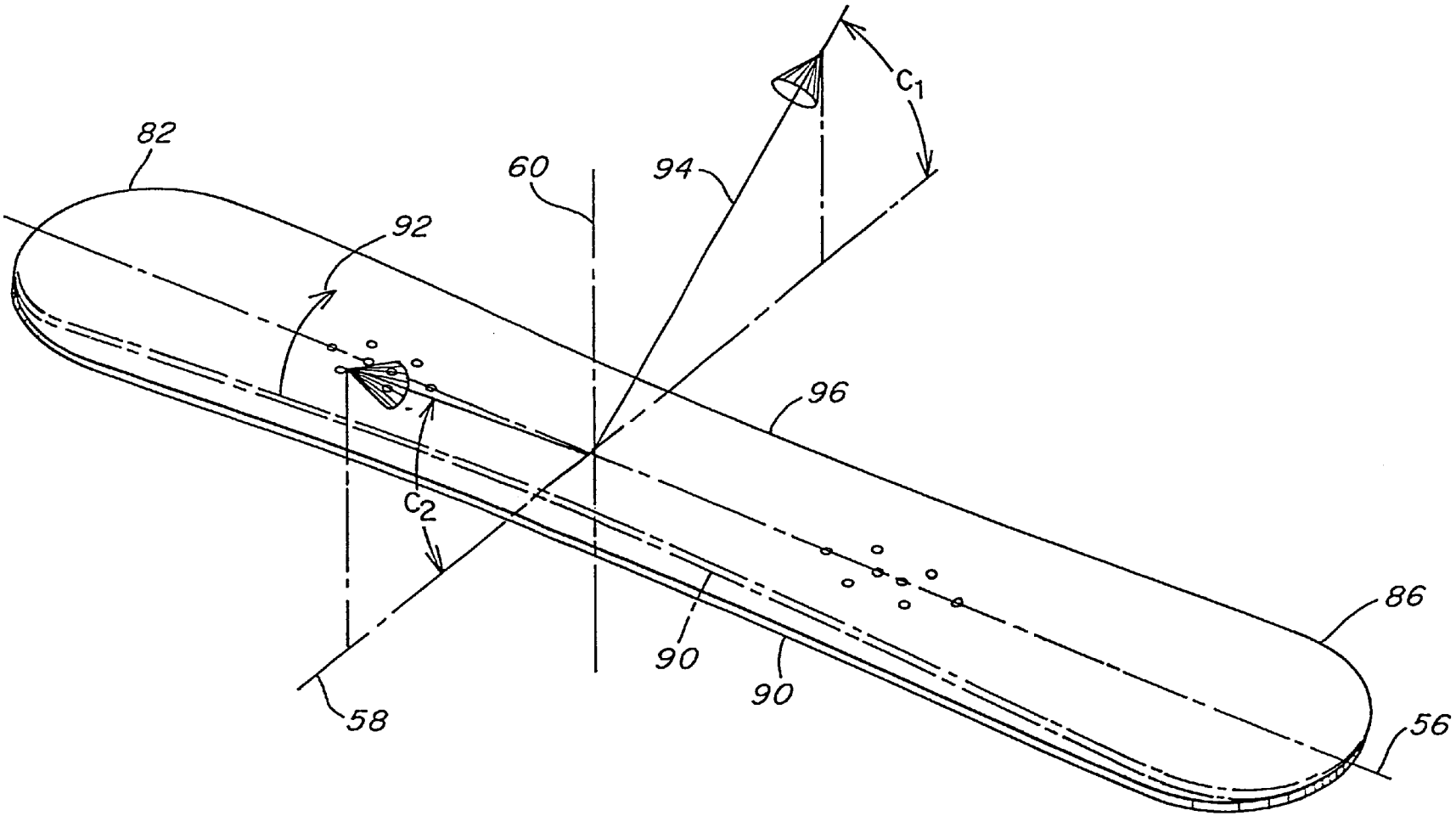
FIG. 12 is a schematic view of a core illustrating one embodiment of an anisotropic structure orientation suitable for handling a shear load due to transverse bending of the core.

FIG. 12 illustrates a principle axis orientation that may be suitable for handling a transverse shear load that is applied to the core approximately midway between the longitudinal axis 56 and an edge 90 of the board. This loading condition may occur when executing a hard turn on edge that causes the toe edge 90 (assuming the board is set up in a regular configuration) to bend upwardly 92, as shown in phantom, along an axis that is parallel to the longitudinal axis 56. Under this loading condition, it may be preferable to orient the principal axis 94 in a plane that is perpendicular to the base plane and parallel to the transverse axis 58 and at an angle $C_1$ from the base plane. For example, the principle axis 94 may be oriented at an angle $C_1$ of −45° from the base plane toward the heel edge 96 of the core. Similar to the orientations described above, the anisotropic structures in this region may all have the same orientation, or various proportions of structures oriented at angles $C_1$ and $C_2$ of ±45° from the base plane toward the edges in the transverse direction 58.

Figure 13:
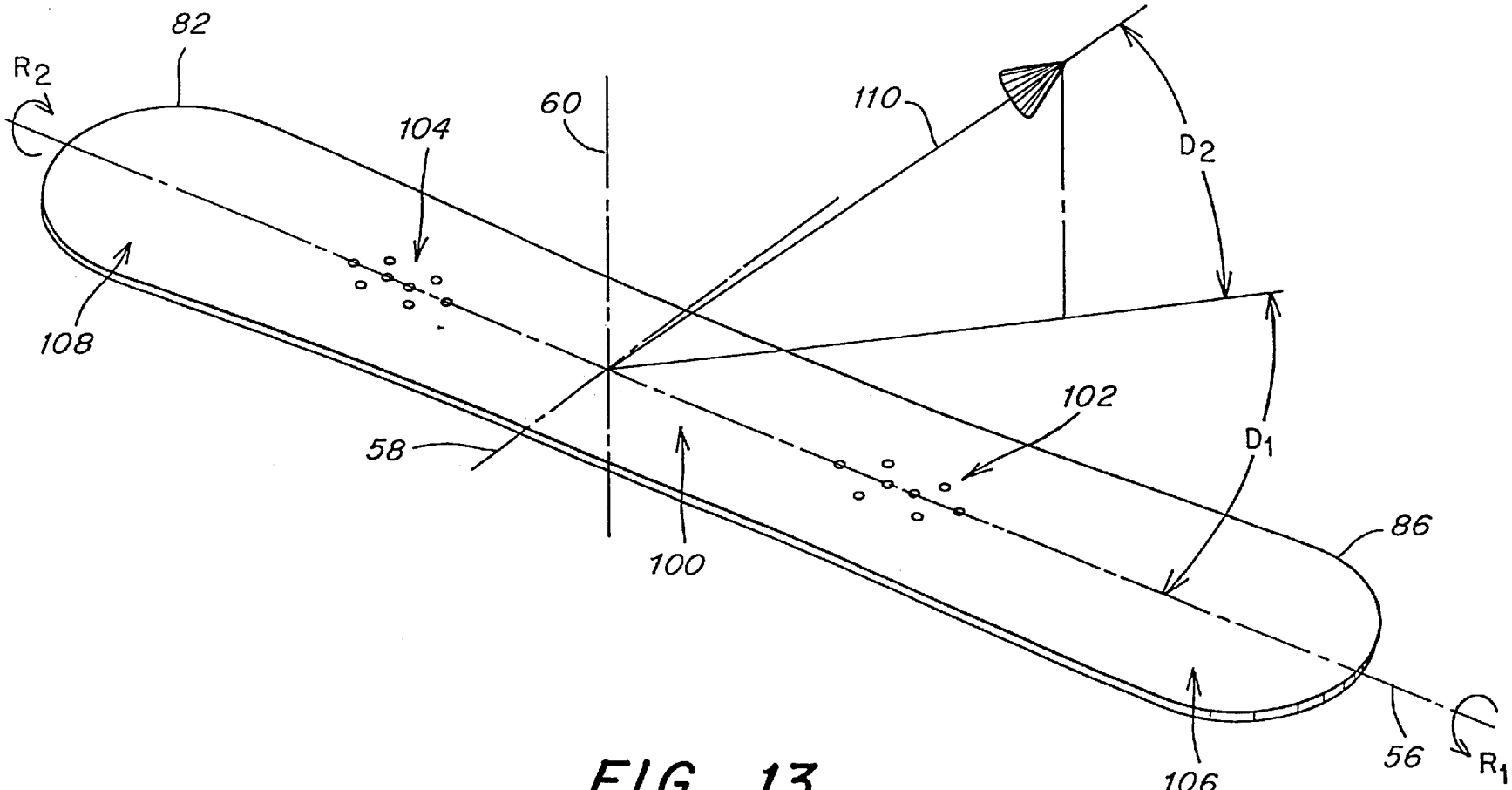
FIG. 13 is a schematic view of a core illustrating one embodiment of an anisotropic structure orientation suitable for handling a torsional load due to twisting of the core.

FIG. 13 illustrates a principle axis orientation that may be suitable for handling a torsional load that is applied to a center portion 100 of the core between the front and rear binding regions 102, 104 off the longitudinal axis 56. This loading condition may occur when initiating and exiting a turn that causes the board to twist along the longitudinal axis 56. In particular, the front portion 106 of the board twists in one direction $R_1$ about the longitudinal axis 56 and the rear portion 108 of the board twists in the opposite direction $R_2$ about the longitudinal axis. Under this loading condition, it may be preferable to orient the principal axis 110 in a plane that is perpendicular to the base plane at an angle $D_1$ from the longitudinal axis 56 and at an angle $D_2$ from the base plane. For example, in the front portion 106 of the core, the principle axis 110 may be oriented at an angle of +45° from the base plane toward the tip end 86 and at an angle of 45° from the longitudinal axis 56. Similarly, in the rear portion 108 of the core, the principle axis 110 may be oriented at an angle of −45° from the base plane toward the tail end 82 and at an angle of 45° from the longitudinal axis 56.

A compression load may be applied to the binding regions when the board is bent due to the loading conditions described in connection with FIGS. 11–12 or under the weight of a rider standing on the board. Under this loading condition, it may be preferable to orient the principal axis perpendicular to the base plane.

High point loads may be applied to a binding fastener insert due to forces acting on the bindings that can cause pull out of the inserts. Under this loading condition, as described above in connection with FIG. 10, it may be preferable to orient the principal axis in a plane that is parallel to the base plane and is oriented in the tip-to-tail direction, the edge-to-edge direction or any radial direction away from the insert. The anisotropic structure is preferably a core segment that acts as a beam to distribute the point loads to a larger area of the board.

Since the actual loading conditions on a board generally include various combinations of these basic loading conditions, the core may preferably include a predetermined arrangement of one or more anisotropic structures that are particularly suited to carry such loads. Different riding styles, varying levels of riding, and the diverse affects of terrain and surface conditions may influence whether a particular loading condition is factored into the design of a core. According to this invention, however, the core may include, in one or more specific regions or completely thereabout, various anisotropic structures that are arranged to address a basic loading condition or a combination of two or more of such basic loading conditions. The anisotropic structure may be oriented so that the principal axis provides a maximum value for a specific loading condition or a blended value that accommodates two or more contemplated loading conditions.

Figure 14:
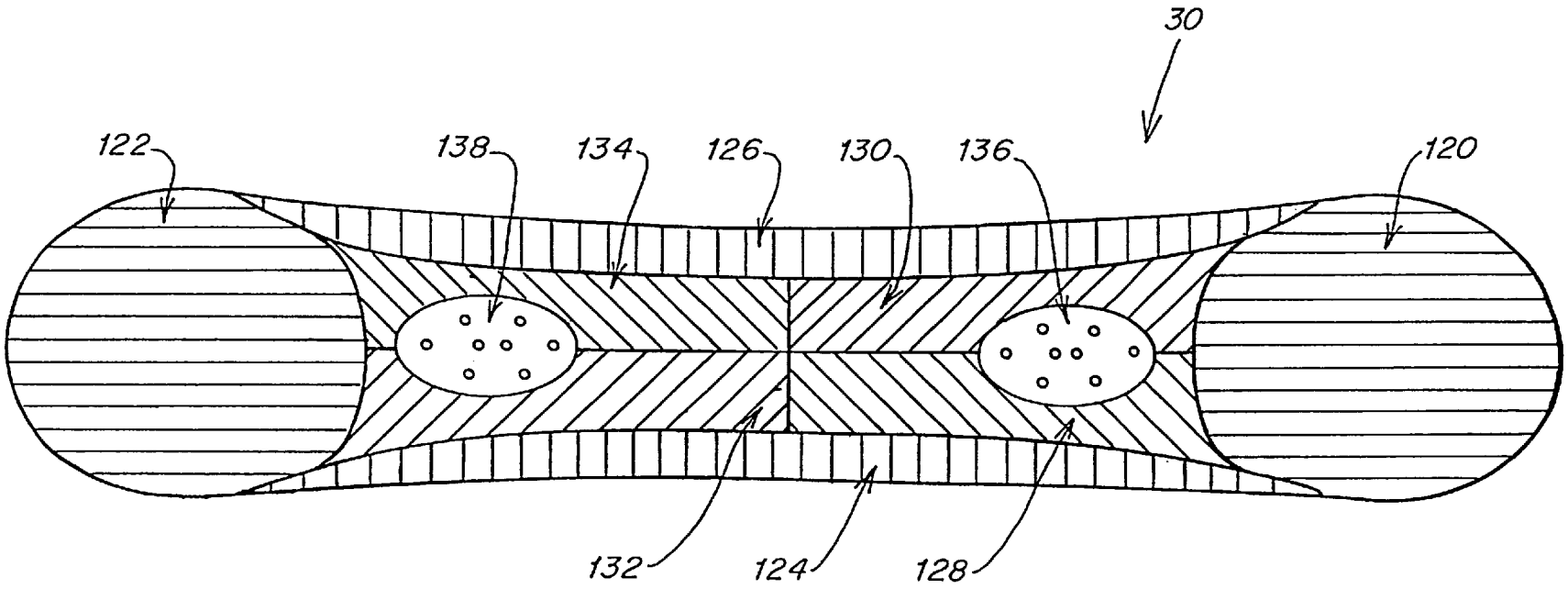
FIG. 14 is a schematic view of a core having multiple regions of varying anisotropic structures for handling various loading conditions.

As illustrated in FIG. 14, a core may include various regions of anisotropic structures that have been configured to handle the basic loading conditions described above. As illustrated, the 30 core may include tip and tail regions 120, 122 having anisotropic structures oriented in the tip-to-tail direction for the bending shear loads induced during jumps. The core may include edge regions 124, 126 with structures oriented in the edge-to-edge direction for transverse bending shear loads induced by hard turns on edge. The center regions 128, 130, 132, 134 of the core may include structures angled relative to the longitudinal axis 56 for torsional loads induced when initiating and exiting turns. The binding regions 136, 138 may include structures that are perpendicular to the base plane for the compressive loads applied during jumps, hard turns on edge and the rider's weight when just standing on the board. In each of these regions, the principal axes may be oriented at various angles relative to the base plane and the longitudinal axis of the core.

Figure 15:
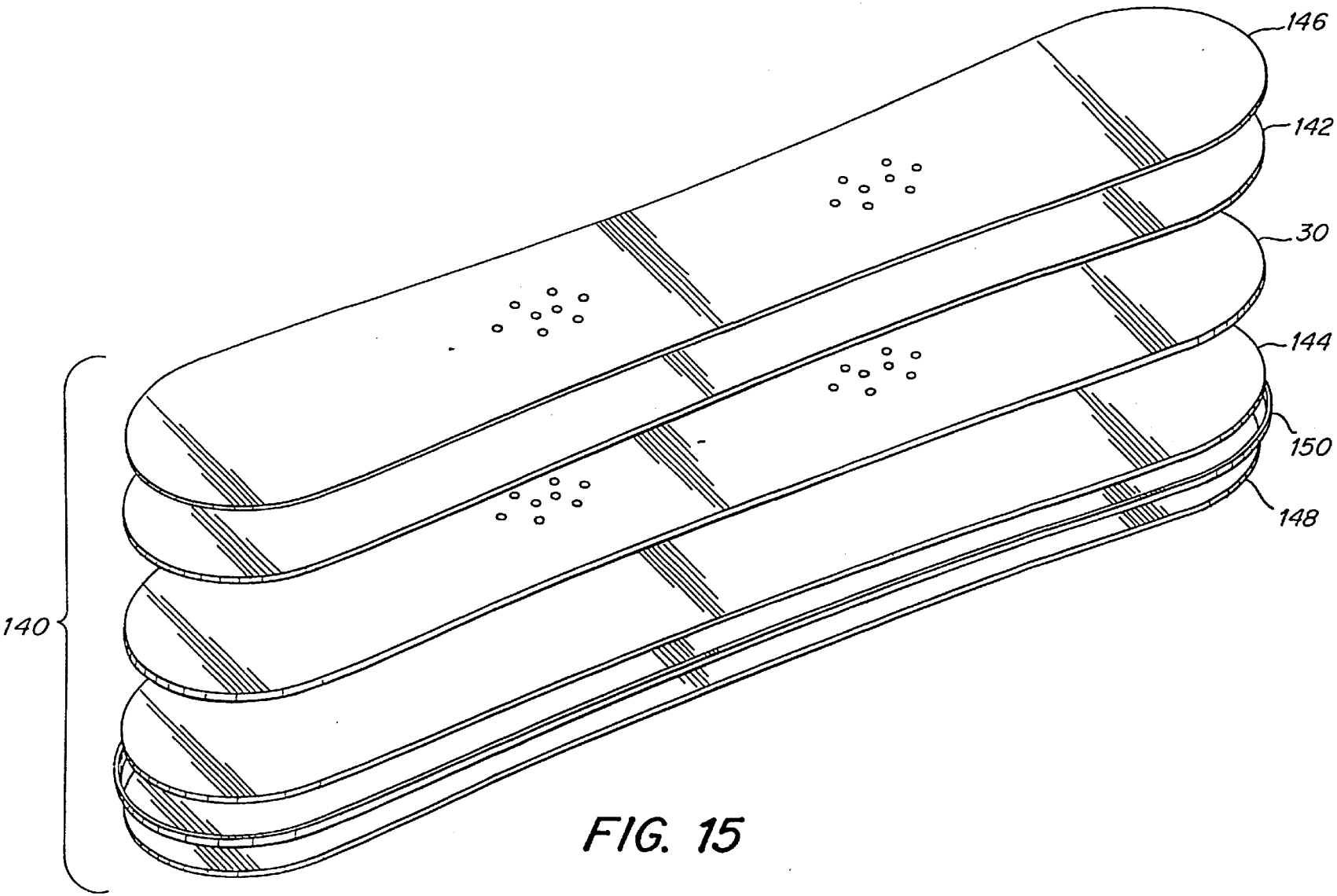
FIG. 15 is an exploded view of a snowboard incorporating the core of the present invention.

A representative gliding board, in this case a snowboard, including a core according to the present invention, is illustrated in FIG. 15. The snowboard 140 includes a core 30 formed of alternating 10 mm wide segments of medium density balsa wood (approximately 9 lbs/ft$^3$ to approximately 13 lbs/ft$^3$). Each of the segments has a width of approximately 10 mm and respective principal axis angles of +45° (first anisotropic structure) and −45° (second anisotropic structure) from the base plane toward the tip end and the tail end, respectively. 10 mm wide long grain segments of medium density aspen wood (having a density of approximately 26 lbs/ft$^3$ or at least of higher density than the balsa segments) extend through a central region of the core and include the fastener insert openings. The segments are vertically laminated together to form a thin, elongated core member having a tip-to-tail length of approximately 60¼ inches, a width of approximately 10⅝ inches at its widest point, a sidecut of approximately 1 inch, and a thickness that varies from approximately 8 mm at the central region to approximately 1.8 mm at the tip.

The core 30 is sandwiched between top and bottom reinforcing layers 142, 144, each preferably consisting of three sheets of fiberglass that are oriented at 0°, +45° and −45° from the longitudinal axis of the board, which assist in controlling longitudinal bending, transverse bending and torsional flex of the board. The reinforcing layers 142, 144 may extend beyond the edges of the core and over a sidewall (not shown) and tip and tail spacers (not shown) to protect the core from damage and deterioration. A scratch resistant top sheet 146 covers the upper reinforcing layer 142 while a gliding surface 148, typically formed from a sintered or extruded plastic, is located at the bottom of the board. Metal edges 150 may wrap around a partial, or preferably a full, perimeter of the board, providing a hard gripping edge for board control on snow and ice. Damping material to reduce chatter and vibrations also may be incorporated into the board.

In order to illustrate the invention, the following examples are presented to recite approximate compressive strength for various anisotropic wood structures. It is to be understood, however, that the examples are included for illustrative purposes only and are not intended to limit the scope of the invention.

Compressive strength measurements were taken by compressing a core specimen using a round tool having an area of approximately 720 mm$^2$ against a flat platen. The following compressive strength values were measured at a core deflection of 1 mm.

| Wood | Grain Orientation | Compressive Strength (Newtons) |
|---|---|---|
| Medium density balsa (8–13 lb/ft$^3$) | end grain | 8000 |
| Low density balsa (6 lb/ft$^3$) | end grain | 2900–4500 |
| Medium density balsa (9.5 lb/ft$^3$) | ±45° | 3300 |

-continued

| Wood | Grain Orientation | Compressive Strength (Newtons) |
|---|---|---|
| Aspen (26 lb/ft$^3$) | long grain | 2900 |

It can be observed from these compression strength measurements that the principal axis orientation can affect the structural character of an anisotropic structure. The principal axis for the maximum compressive strength of wood lies along the grain direction. For example, orienting the grain (principal axis) of the highest density wood (aspen) perpendicular to the compressive load direction produces a lower strength structure than orienting the grain of a lower density material (medium density balsa) parallel to the load. Additionally, orienting the grain of the medium density balsa parallel to the load produces a higher strength structure than orienting the grain ±45° to the load.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. A core for a gliding board, comprising:

an elongated, thin core member constructed and arranged for incorporation into a gliding board and having a tip end, a tail end and a pair of opposed edges, wherein said core member has a longitudinal axis extending in a tip-to-tail direction, a transverse axis extending in an edge-to-edge direction perpendicular to said longitudinal axis, and a normal axis that is perpendicular to a base plane extending through said longitudinal axis and said transverse axis, said core member including a plurality of vertically laminated anisotropic structures, said plurality of vertically laminated anisotropic structures including first and second anisotropic structures, said first and second anisotropic structures having first and second principal axes, respectively, along which a mechanical property of said first and second anisotropic structures has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein said first principal axis is oriented in a first direction and lies in a first plane that is parallel to said base plane, and said second principal axis is oriented in a second direction that is non-parallel to said first direction.

2. The gliding board core recited in claim 1, wherein said second principal axis is oriented with at least one angle of between 10° and 80° relative to any one of said longitudinal axis, said transverse axis and said normal axis.

3. The gliding board core recited in claim 2, wherein said angle is approximately 45°.

4. The gliding board core recited in claim 1, wherein said second principal axis lies in a second plane extending parallel to a longitudinal plane extending through said longitudinal axis and said normal axis.

5. The gliding board core recited in claim 1, wherein said second principal axis lies in a second plane extending parallel to a transverse plane extending through said transverse axis and said normal axis.

6. The gliding board core recited in claim 5, wherein said first direction is parallel to said longitudinal axis.

7. The gliding board core recited in claim 1, wherein said second principal axis lies in a second plane that is perpendicular to said base plane, said second plane being non-parallel to said longitudinal axis and said transverse axis.

8. The gliding board core recited in claim 7, wherein said first direction is parallel to said longitudinal axis.

9. The gliding board core recited in claim 1, wherein said plurality of vertically laminated anisotropic structures includes a plurality of said first anisotropic structures and a plurality of said second anisotropic structures.

10. The gliding board core recited in claim 1, wherein said first and second anisotropic structures are formed from an anisotropic material.

11. The gliding board core recited in claim 10, wherein said first and second anisotropic structures include wood.

12. The gliding board recited in claim 11, wherein said first and second principal axes of said wood anisotropic structures lie along a grain of said wood anisotropic structures.

13. The gliding board core recited in claim 1, wherein said core member is constructed and arranged to be incorporated in a snowboard.

14. The gliding board core recited in claim 1, wherein said core member includes a first region with said first anisotropic structure and a pair of second regions with said second anisotropic structure disposed along said pair of opposite edges, said first region being disposed between said pair of second regions.

15. The gliding board core recited in claim 14, wherein said first direction is parallel to said longitudinal axis.

16. The gliding board core recited in claim 14, wherein said second plane is parallel to said transverse axis.

17. The gliding board core recited in claim 16, wherein said first direction is parallel to said longitudinal axis.

18. The gliding board core recited in claim 1, in combination with said gliding board, said gliding board core being incorporated into said gliding board.

19. The combination recited in claim 18, wherein said gliding board is a snowboard.

20. A core for a gliding board, comprising:

an elongated core member constructed and arranged for incorporation into a gliding board, said core member including top and bottom outer surfaces and having a tip end, a tail end and a pair of opposed edges, wherein said core member has a longitudinal axis extending in a tip-to-tail direction, a transverse axis extending in an edge-to-edge direction perpendicular to said longitudinal axis, and a normal axis that is perpendicular to a base plane extending through said longitudinal axis and said transverse axis, said core member including a first anisotropic structure formed from an anisotropic material and a second anisotropic structure formed from an anisotropic material, each extending continuously from said top outer surface to said bottom outer surface, said first and second anisotropic structures having first and second principal axes, respectively, along which a mechanical property of said anisotropic structures has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein said first principal axis is oriented in a first direction and lies in a first plane that is parallel to said base plane, and said second principal axis is oriented in a second direction that is non-parallel to said first direction.

21. The gliding board core recited in claim 20, wherein said second principal axis is oriented with at least one angle of between 10° and 80° relative to any one of said longitudinal axis, said transverse axis and said normal axis.

22. The gliding board core recited in claim 21, wherein said angle is approximately 45°.

23. The gliding board core recited in claim 20, wherein said second principal axis lies in a second plane extending parallel to a longitudinal plane extending through said longitudinal axis and said normal axis.

24. The gliding board core recited in claim 20, wherein said second principal axis lies in a second plane extending parallel to a transverse plane extending through said transverse axis and said normal axis.

25. The gliding board core recited in claim 24, wherein said first direction is parallel to said longitudinal axis.

26. The gliding board core recited in claim 20, wherein said second principal axis lies in a second plane that is perpendicular to said base plane, said second plane being non-parallel to said longitudinal axis and said transverse axis.

27. The gliding board core recited in claim 26, wherein said first direction is parallel to said longitudinal axis.

28. The gliding board core recited in claim 20, wherein said core member includes a plurality of vertically laminated first and second anisotropic structures.

29. The gliding board core recited in claim 20, wherein said first and second anisotropic structures include wood.

30. The gliding board recited in claim 29, wherein said first and second principal axes of said wood anisotropic structures lie along a grain of said wood anisotropic structures.

31. The gliding board core recited in claim 20, wherein said core member is constructed and arranged to be incorporated in a snowboard.

32. The gliding board core recited in claim 20, wherein said core member includes a first region said first anisotropic structure and a pair of second regions with said second anisotropic structure disposed along said pair of opposite edges, said first region being disposed between said pair of second regions.

33. The gliding board core recited in claim 32, wherein said first direction is parallel to said longitudinal axis.

34. The gliding board core recited in claim 32, wherein said second plane is parallel to said transverse axis.

35. The gliding board core recited in claim 34, wherein said first direction is parallel to said longitudinal axis.

36. The gliding board core recited in claim 20, in combination with said gliding board, said gliding board core being incorporated into said gliding board.

37. The combination recited in claim 36, wherein said gliding board is a snowboard.

38. A core for a gliding board, comprising:

an elongated core member constructed and arranged for incorporation into a gliding board, said core member including top and bottom outer surfaces and having a tip end, a tail end and a pair of opposed edges, wherein said core member has a longitudinal axis extending in a tip-to-tail direction, a transverse axis extending in an edge-to-edge direction perpendicular to said longitudinal axis, and a normal axis that is perpendicular to a base plane extending through said longitudinal axis and said transverse axis, said core member including a first anisotropic structure and a second anisotropic structure, each formed from a material selected from the group consisting of a fiber-impregnated resin and a molded thermoplastic, said first and second anisotropic structures having first and second principal axes, respectively, along which a mechanical property of said first and second anisotropic structures has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein said first principal axis is oriented in a first direction and lies in a first plane that is parallel to said base plane, and said second principal axis is oriented in a second direction that is non-parallel to said first direction.

39. The gliding board core recited in claim 38, wherein said second principal axis is oriented with at least one angle of between 10° and 80° relative to any one of said longitudinal axis, said transverse axis and said normal axis.

40. The gliding board core recited in claim 39, wherein said angle is approximately 45°.

41. The gliding board core recited in claim 38, wherein said second principal axis lies in a second plane extending parallel to a longitudinal plane extending through said longitudinal axis and said normal axis.

42. The gliding board core recited in claim 38, wherein said second principal axis lies in a second plane extending parallel to a transverse plane extending through said transverse axis and said normal axis.

43. The gliding board core recited in claim 42, wherein said first direction is parallel to said longitudinal axis.

44. The gliding board core recited in claim 38, wherein said second principal axis lies in a second plane that is perpendicular to said base plane, said second plane being non-parallel to said longitudinal axis and said transverse axis.

45. The gliding board core recited in claim 44, wherein said first direction is parallel to said longitudinal axis.

46. The gliding board core recited in claim 38, wherein said core member is constructed and arranged to be incorporated in a snowboard.

47. The gliding board core recited in claim 38, in combination with said gliding board, said gliding board core being incorporated into said gliding board.

48. The combination recited in claim 47, wherein said gliding board is a snowboard.

49. The gliding board core recited in claim 38, wherein said first and second anisotropic structures extend from said top outer surface to said bottom outer surface.

50. The gliding board core recited in claims 38, wherein said fiber-impregnated resin includes a plurality of fibers oriented in said first and second directions.

51. A core for a gliding board, comprising:

an elongated, thin core member constructed and arranged for incorporation into a gliding board and having a tip end, a tail end and a pair of opposed edges, wherein said core member has a longitudinal axis extending in a tip-to-tail direction, a transverse axis extending in an edge-to-edge direction perpendicular to said longitudinal axis, and a normal axis that is perpendicular to a base plane extending through said longitudinal axis and said transverse axis, said core member including a plurality of vertically laminated anisotropic structures, said plurality of vertically laminated anisotropic structures including first and second anisotropic structures, said first and second anisotropic structures having first and second principal axes, respectively, along which a mechanical property of said first and second anisotropic structures has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein said first principal axis is oriented in a first direction that is non-parallel to the normal axis and lies in a first plane that is parallel to a transverse plane extending through said transverse and normal axes, and said second principal axis is oriented in a second direction that is non-parallel to said first direction.

52. The gliding board core recited in claim 51, wherein said first principal axis is oriented with at least one angle of between 10° and 80° relative to any one of said longitudinal axis, said transverse axis and said normal axis.

53. The gliding board core recited in claim 52, wherein said angle is approximately 45°.

54. The gliding board core recited in claim 51, wherein said second principal axis lies in a second plane extending parallel to a longitudinal plane extending through said longitudinal axis and said normal axis.

55. The gliding board core recited in claim 51, wherein said second principal axis lies in a second plane that is non-parallel to said first plane.

56. The gliding board core recited in claim 55, wherein said second direction is parallel to said longitudinal axis.

57. The gliding board core recited in claim 51, wherein said second direction is parallel to said longitudinal axis.

58. The gliding board core recited in claim 51, wherein said plurality of vertically laminated anisotropic structures includes a plurality of said first anisotropic structures and a plurality of said second anisotropic structures.

59. The gliding board core recited in claim 51, wherein said first and second anisotropic structures are formed from an anisotropic material.

60. The gliding board core recited in claim 59, wherein said first and second anisotropic structures include wood.

61. The gliding board recited in claim 60, wherein said first and second principal axes of said wood anisotropic structures lie along a grain of said wood anisotropic structures.

62. The gliding board core recited in claim 51, wherein said core member is constructed and arranged to be incorporated in a snowboard.

63. The gliding board core recited in claim 51, wherein said core member includes a first region with said first anisotropic structure and a pair of second regions with said second anisotropic structure disposed along said pair of opposite edges, said first region being disposed between said pair of second regions.

64. The gliding board core recited in claim 63, wherein said second direction is parallel to said longitudinal axis.

65. The gliding board core recited in claim 51, in combination with said gliding board, said gliding board core being incorporated into said gliding board.

66. The combination recited in claim 65, wherein said gliding board is a snowboard.

67. A core for a gliding board, comprising:

an elongated core member constructed and arranged for incorporation into a gliding board, said core member including top and bottom outer surfaces and having a tip end, a tail end and a pair of opposed edges, wherein said core member has a longitudinal axis extending in a tip-to-tail direction, a transverse axis extending in an edge-to-edge direction perpendicular to said longitudinal axis, and a normal axis that is perpendicular to a base plane extending through said longitudinal axis and said transverse axis, said core member including a first anisotropic structure formed from an anisotropic material and a second anisotropic structure formed from an anisotropic material, each extending continuously from said top outer surface to said bottom outer surface, said first and second anisotropic structures having first and second principal axes, respectively, along which a mechanical property of said anisotropic structures has a maximum value, said mechanical property being selected from the group consisting of compressive strength, compressive stiffness, compressive fatigue strength, compressive creep strength, tensile strength, tensile stiffness, tensile fatigue strength and tensile creep strength, wherein said first principal axis is oriented in a first direction that is non-parallel to the normal axis and lies in a first plane that is parallel to a transverse plane extending through said transverse and normal axes, and said second principal axis is oriented in a second direction that is non-parallel to said first direction.

68. The gliding board core recited in claim 67, wherein said first principal axis is oriented with at least one angle of between 10° and 80° relative to any one of said longitudinal axis, said transverse axis and said normal axis.

69. The gliding board core recited in claim 68, wherein said angle is approximately 45°.

70. The gliding board core recited in claim 67, wherein said second principal axis lies in a second plane extending parallel to a longitudinal plane extending through said longitudinal axis and said normal axis.

71. The gliding board core recited in claim 67, wherein said second principal axis lies in a second plane that is non-parallel to said first plane.

72. The gliding board core recited in claim 71, wherein said second direction is parallel to said longitudinal axis.

73. The gliding board core recited in claim 67, wherein said second direction is parallel to said longitudinal axis.

74. The gliding board core recited in claim 67, wherein said core member includes a plurality of vertically laminated first and second anisotropic structures.

75. The gliding board core recited in claim 67, wherein said first and second anisotropic structures include wood.

76. The gliding board recited in claim 75, wherein said first and second principal axes of said wood anisotropic structures lie along a grain of said wood anisotropic structures.

77. The gliding board core recited in claim 67, wherein said core member is constructed and arranged to be incorporated in a snowboard.

78. The gliding board core recited in claim 67, wherein said core member includes a first region with said first anisotropic structure and a pair of second regions with said second anisotropic structure disposed along said pair of opposite edges, said first region being disposed between said pair of second regions.

79. The gliding board core recited in claim 78, wherein said second direction is parallel to said longitudinal axis.

80. The gliding board core recited in claim 67, in combination with said gliding board, said gliding board core being incorporated into said gliding board.

81. The combination recited in claim 80, wherein said gliding board is a snowboard.

82. A core for a gliding board, comprising:

an elongated core member constructed and arranged for incorporation into a gliding board, said core member including top and bottom outer surfaces and having a tip end, a tail end and a pair of opposed edges, wherein said core member has a longitudinal axis extending in a tip-to-tail direction, a transverse axis extending in an edge-to-edge direction perpendicular to said longitudinal axis, and a normal axis that is perpendicular to a base plane extending through said longitudinal axis and said transverse axis, said core member including a first anisotropic structure and a second anisotropic structure, each formed from a material selected from the group consisting of a fiber-impregnated resin and a molded thermoplastic, said first and second anisotropic structures having first and second principal axes, respectively, along which a mechanical property of said first and second anisotropic structures has a maximum value, said mechanical property being selected from the group consisting of compressive strength compressive stiffness, compressive fatigue strength, compressive creep strength, tensile strength, tensile stiffness, tensile fatigue strength and tensile creep strength, wherein said first principal axis is oriented in a first direction that is non-parallel to the normal axis and lies in a first plane that is parallel to a transverse plane extending through said transverse and normal axes, and said second principal axis is oriented in a second direction that is non-parallel to said first direction.

83. The gliding board core recited in claim 82, wherein said first principal axis is oriented with at least one angle of between 10° and 80° relative to any one of said longitudinal axis, said transverse axis and said normal axis.

84. The gliding board core recited in claim 83, wherein said angle is approximately 45°.

85. The gliding board core recited in claim 82, wherein said second principal axis lies in a second plane extending parallel to a longitudinal plane extending through said longitudinal axis and said normal axis.

86. The gliding board core recited in claim 82, wherein said second principal axis lies in a second plane that is non-parallel to said first plane.

87. The gliding board core recited in claim 86, wherein said second direction is parallel to said longitudinal axis.

88. The gliding board core recited in claim 82, wherein said core member is constructed and arranged to be incorporated in a snowboard.

89. The gliding board core recited in claim 88, in combination with said gliding board, said gliding board core being incorporated into said gliding board.

90. The combination recited in claim 89, wherein said gliding board is a snowboard.

91. The gliding board core recited in claim 82, wherein said first and second anisotropic structures extend from said top outer surface to said bottom outer surface.

92. The gliding board core recited in claim 82, wherein said fiber-impregnated resin includes a plurality of fibers oriented in said first and second directions.

* * * * *